US011040236B1

(12) United States Patent
Chen

(10) Patent No.: US 11,040,236 B1
(45) Date of Patent: Jun. 22, 2021

(54) ADJUSTABLE EXERCISE DEVICE

(71) Applicant: FLORIEY INDUSTRIES INTERNATIONAL CO., Taichung (TW)

(72) Inventor: Paul Chen, Taichung (TW)

(73) Assignee: FLORIEY INDUSTRIES INTERNATIONAL CO., Taichung (TW)

( * ) Notice: Subject to any disclaimer, the term of this patent is extended or adjusted under 35 U.S.C. 154(b) by 11 days.

(21) Appl. No.: 16/721,989

(22) Filed: Dec. 20, 2019

(51) Int. Cl.
*A63B 21/075* (2006.01)
*A63B 21/072* (2006.01)

(52) U.S. Cl.
CPC ..... *A63B 21/075* (2013.01); *A63B 21/0726* (2013.01); *A63B 21/0728* (2013.01)

(58) Field of Classification Search
CPC ... A63B 21/075; A63B 21/0724; A63B 23/12; A63B 21/4043; A63B 21/00065; A63B 21/0728; A63B 21/0726; A63B 21/00061; A63B 21/00069; A63B 21/4035
See application file for complete search history.

(56) References Cited

U.S. PATENT DOCUMENTS 4,029,312 A * 6/1977 Wright ..... A63B 21/0602 482/108
4,743,017 A * 5/1988 Jaeger ..... A63B 21/075 482/108
4,768,780 A * 9/1988 Hayes ..... A63B 21/0724 482/106
D315,003 S * 2/1991 Huang ..... D21/682
5,033,739 A * 7/1991 MacKechnie .... A63B 21/00069 482/111
5,407,413 A * 4/1995 Kupferman ..... A63B 21/0728 482/106
5,637,064 A * 6/1997 Olson ..... A63B 21/0728 482/107
5,779,604 A * 7/1998 Towley, III ..... A63B 21/0728 482/107
5,839,997 A 11/1998 Roth et al.
6,149,558 A * 11/2000 Chen ..... A63B 21/0728 482/107
6,186,928 B1 * 2/2001 Chen ..... A63B 21/0728 482/107
6,196,952 B1 * 3/2001 Chen ..... A63B 21/0728 482/107
6,500,101 B1 * 12/2002 Chen ..... A63B 21/0728 482/107

(Continued)

*Primary Examiner* — Garrett K Atkinson
(74) *Attorney, Agent, or Firm* — Browdy and Neimark, PLLC

(57) ABSTRACT

An adjustable dumbbell device includes two weights engageable to a receptacle, and a handle mechanism includes a handle bar having two end housings, two tubular members are engaged between the housings and offset from each other and each include a bore for slidably receiving and engaging with a latch, the latches are extendible out of the tubular members for engaging with the weights and for retaining the weights to the housings, and two spring biased knobs are attached to the latches for actuating the latches to engage with the weights respectively. The tubular members each include a groove communicating with the bore of the tubular member for slidably engaging with the spring biased knob.

10 Claims, 4 Drawing Sheets

(56) References Cited

U.S. PATENT DOCUMENTS 6,656,093 B2 * 12/2003 Chen ..... A63B 21/075 482/107
D498,272 S * 11/2004 Sanford-Schwentke .... D21/681
6,971,974 B2 * 12/2005 Bowman ..... A63B 21/0728 482/106
7,090,625 B2 * 8/2006 Chermack ..... A63B 21/075 482/107
7,223,214 B2 * 5/2007 Chen ..... A63B 21/075 482/107
7,413,533 B2 * 8/2008 Lin ..... A63B 21/075 482/106
7,578,772 B2 * 8/2009 Lippitt ..... A63B 21/0728 482/106
7,604,578 B2 * 10/2009 Liu ..... A63B 21/075 482/106
7,704,197 B2 * 4/2010 Yu ..... A63B 21/063 482/108
7,731,641 B1 * 6/2010 Chen ..... A63B 21/0728 482/108
7,811,213 B2 * 10/2010 Chen ..... A63B 21/075 482/108
D643,481 S * 8/2011 Rauwerdink ..... D21/681
8,025,613 B1 * 9/2011 Wang ..... A63B 21/0726 482/107
D651,672 S * 1/2012 Towley, III ..... D21/681
8,668,630 B2 * 3/2014 Towley, III ..... A63B 21/075 482/93
9,011,299 B2 * 4/2015 Lien ..... A63B 21/075 482/108
9,375,602 B2 * 6/2016 Krull ..... A63B 21/075
9,604,092 B2 * 3/2017 Krull ..... A63B 24/0062
9,616,273 B2 * 4/2017 Chen ..... A63B 21/075
9,713,736 B2 * 7/2017 Kao ..... A63B 23/12
9,943,719 B2 * 4/2018 Smith ..... A63B 21/075
10,166,431 B2 * 1/2019 Towley, III ..... A63B 21/0726
10,343,010 B2 7/2019 Chen
10,518,123 B2 * 12/2019 Moran ..... A63B 21/075
10,864,403 B2 * 12/2020 Towley, III ..... A63B 21/0728
2009/0042700 A1 * 2/2009 Liu ..... A63B 21/075 482/107
2012/0021877 A1 * 1/2012 Lundquist ..... A63B 21/075 482/107
2017/0050073 A1 * 2/2017 Kao ..... A63B 21/0728

* cited by examiner

ADJUSTABLE EXERCISE DEVICE

BACKGROUND OF THE INVENTION

1. Field of the Invention

The present invention relates to an adjustable exercise device, and more particularly to an adjustable barbell, kettle bell, or dumbbell having a solid and stable structure or configuration for solidly and stably coupling the weight members of the dumbbell together and for preventing the weight members of the adjustable dumbbell from being disengaged or separated from each other, and arranged for allowing the weight or the size or the standard of the weight members or of the adjustable exercise device or the adjustable dumbbell to be suitably increased.

2. Description of the Prior Art

Various kinds of typical adjustable barbells, kettle bells, or dumbbells have been developed and provided for conducting various exercise operations, for example, U.S. Pat. No. 5,407,413 to Kupferman, U.S. Pat. No. 5,839,997 to Roth et al., U.S. Pat. No. 6,656,093 to Chen, U.S. Pat. No. 7,223,214 to Chen, U.S. Pat. No. 7,731,641 to Chen, U.S. Pat. No. 7,811,213 to Chen, U.S. Pat. No. 9,616,273 to Chen, and U.S. Pat. No. 10,343,010 to Chen disclose several of the typical adjustable dumbbells each including a number of weight rings or weight members that may be selectively or adjustably secured together for adjusting the weight of the dumbbells.

Normally, in the typical adjustable dumbbells, a single central handle bar is provided to be engaged with or between the weight rings or the weight members, and the weight rings or the weight members are to be disposed and engaged on the end portions of the central handle bar.

When the weight rings or the weight members include a relatively smaller weight, such as a weight less than fifty (50) pounds, for example, the weight rings or the weight members may be solidly and stably engaged on the end portions of the central handle bar.

However, when the weight rings or the weight members include a relatively greater weight, such as a weight greater than sixty or seventy pounds, for example, the weight rings or the weight members may not be solidly and stably engaged on the end portions of the central handle bar, and may have a good chance to be disengaged or separated from the handle bar, or the user may feel that the weight rings or the weight members may not be solidly and stably held and carried with the central handle bar.

The present invention has arisen to mitigate and/or obviate the afore-described disadvantages of the conventional adjustable barbells, kettle bells, or dumbbells.

SUMMARY OF THE INVENTION

The primary objective of the present invention is to provide an adjustable barbell, kettle bell, or dumbbell including a solid and stable structure or configuration for solidly and stably coupling the weight members of the dumbbell together and for preventing the weight members of the adjustable dumbbell from being disengaged or separated from each other.

The other objective of the present invention is to provide an adjustable barbell, kettle bell, or dumbbell arranged for allowing the weight or the size or the standard of the weight members or of the adjustable exercise device or the adjustable dumbbell to be suitably increased.

In accordance with one aspect of the invention, there is provided an adjustable dumbbell comprising a receptacle, a first weight and a second weight engageable to the receptacle, the first weight including an orifice formed in the first weight, and the second weight including an aperture formed in the second weight, and a handle mechanism including a handle bar having two end portions, and a first and a second housings disposed on the end portions of the handle bar respectively, a first and a second tubular members engaged between the first and the second housings and offset or separated from each other, the first and the second tubular members each including a bore formed in the first and the second tubular members respectively, the first housing including an opening formed in the first housing and aligned with the bore of the first tubular member, and the second housing including a hole formed in the second housing and aligned with the bore of the second tubular member, a first latch slidably received and engaged in the bore of the first tubular member and extendible out of the opening of the first housing for engaging with the orifice of the first weight and for retaining the first weight to the first housing, and a second latch slidably received and engaged in the bore of the second tubular member and extendible out of the aperture of the second housing for engaging with the hole of the second weight and for retaining the second weight to the second housing and for allowing the weights to be solidly and stably coupled and retained to the housings, and for preventing the weights from being disengaged or separated from the housings of the handle mechanism, and for allowing the weight or the size or the standard or the volume of the weight members to be suitably increased.

The handle mechanism includes a first and a second spring biased knobs attached to the first and the second latches respectively for actuating and moving the latches to engage with the first and/or the second weights and for detachably or changeably attaching the weights to the housings of the handle mechanism respectively.

The first and the second tubular members each include a groove communicating with the bore of the tubular member for slidably receiving and engaging with the spring biased knob and for guiding and limiting the spring biased knob and the latches to move relative to the tubular members and the weights. The first and the second tubular members each include a plurality of cavities communicating with the bore of the tubular member for receiving and engaging with the spring biased knob and for anchoring or positioning the spring biased knob to the tubular member at the required or predetermined position.

The first and the second housings each include an anchoring member, such as a dovetail slot formed in an outer side portion, and the first and the second weights each include an anchoring element, such as a dovetail formed on an inner side portion for engaging with the anchoring member and for anchoring and retaining the first and the second weights to the first and the second housings respectively. The first and the second weights each include an anchoring member formed in an outer side portion for engaging with the anchoring elements of the other weights.

A third weight includes an anchoring element formed on an inner side portion for engaging with the anchoring member of the first weight and for anchoring and retaining the first and the third weights together, the third weight includes an orifice formed in the third weight and aligned with the orifice of the first weight for receiving and engaging with the first latch, a fourth weight includes an anchoring element formed on an inner side portion for engaging with the anchoring member of the second weight and for anchoring and retaining the second and the fourth weights together, and the fourth weight includes an aperture formed in the fourth weight and aligned with the aperture of the second weight for receiving and engaging with the second latch.

The receptacle includes one or more partitions extended from receptacle and disposed between the first and the second weights for anchoring and positioning the weights in place. The partition includes a notch formed in the partition for receiving and engaging with the handle bar and for solidly and stably anchoring and positioning the handle bar of the handle mechanism in place.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
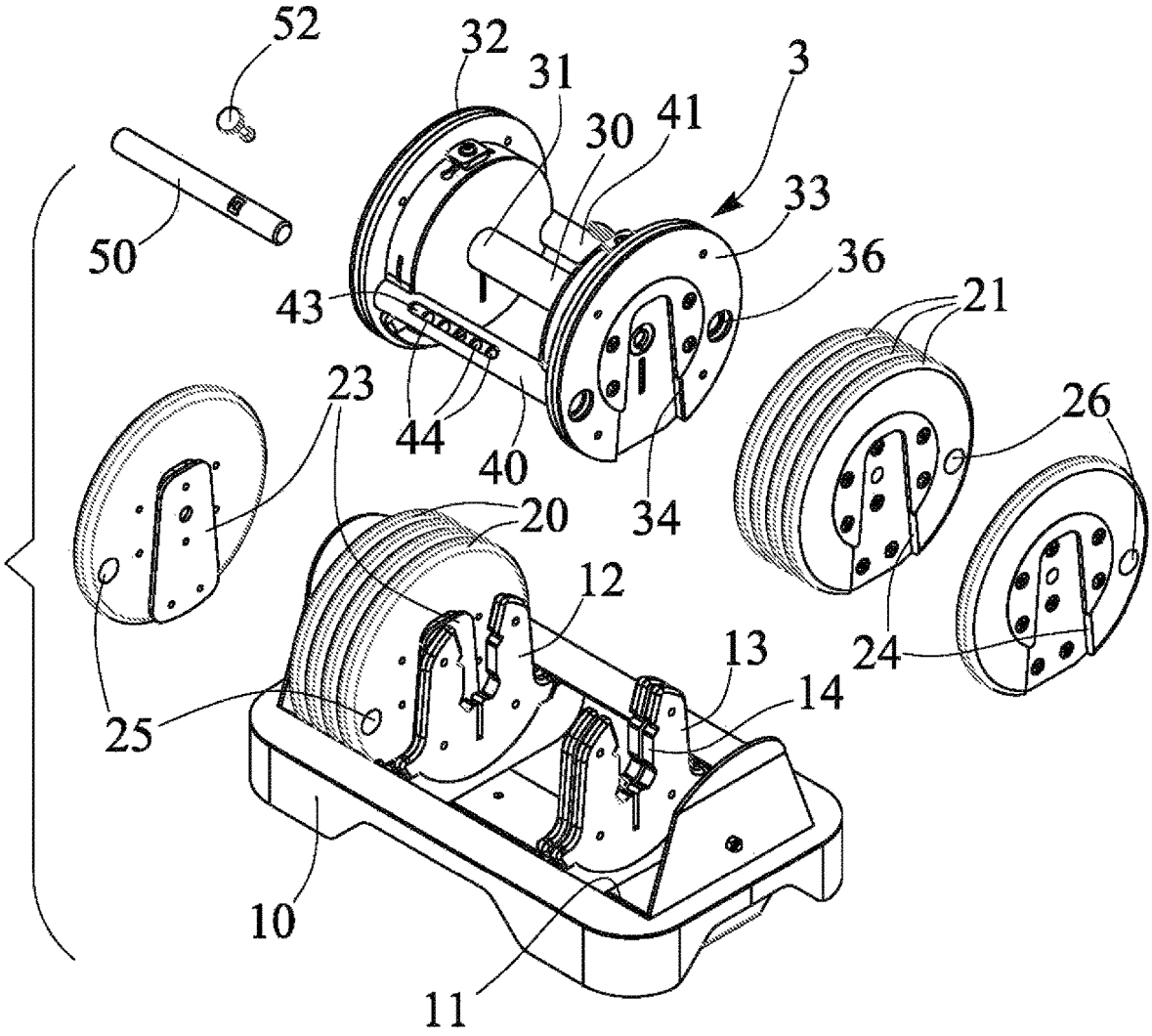
FIG. 1 is a partial exploded view of an adjustable dumbbell in accordance with the present invention.
Figure 2:
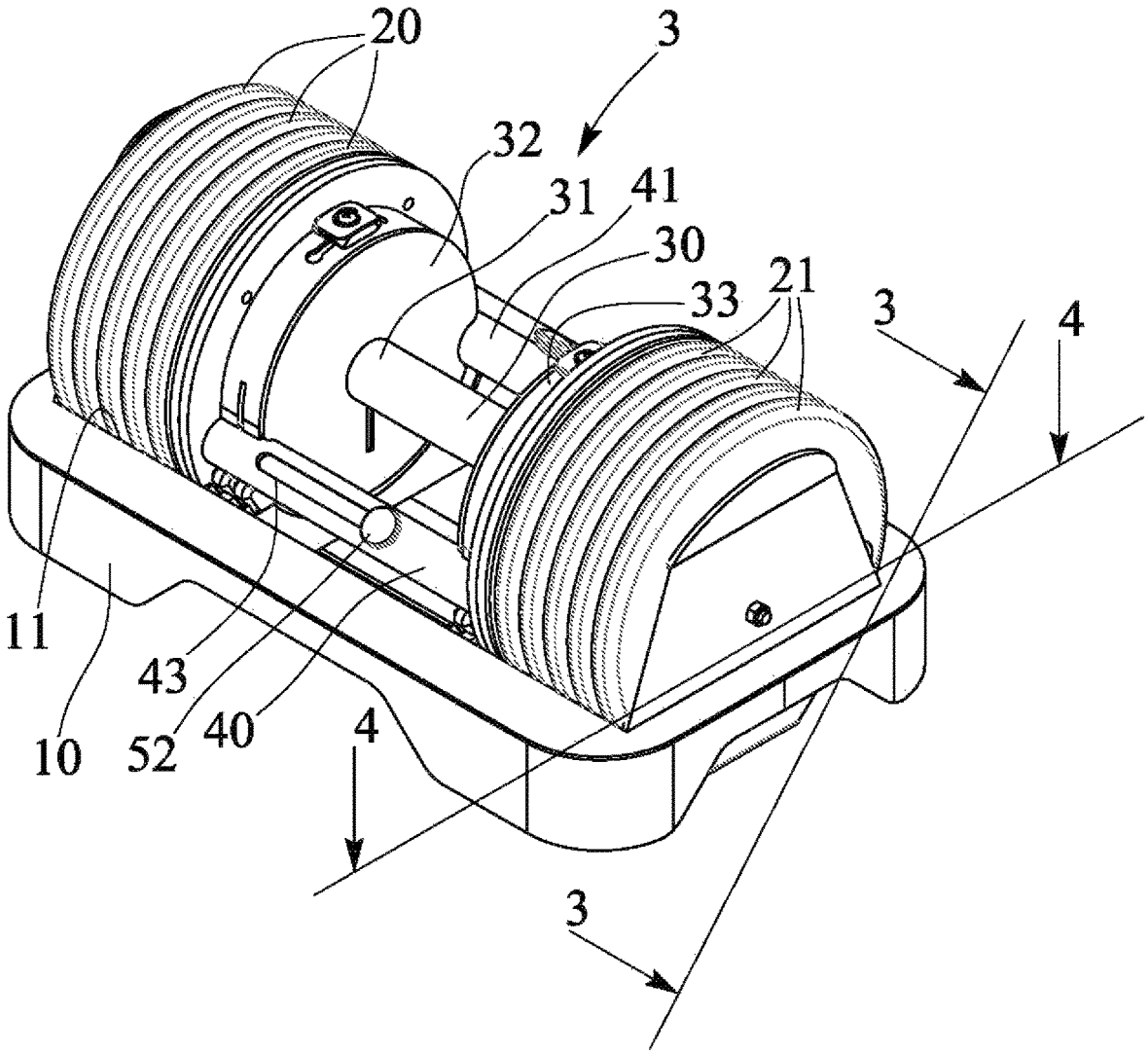
FIG. 2 is a perspective view of the adjustable dumbbell.

Referring to the drawings, and initially to FIGS. 1-4, an adjustable exercise device, such as an adjustable barbell, kettle bell, or dumbbell in accordance with the present invention comprises a supporting base or receptacle 10 including one or more (such as two) depressions or recesses or compartments 11 formed therein for selectively receiving or engaging with two groups of weights 20, 21, such as weight rings or plates or members or elements, and including one or more (such as two) spacer plates or partitions 12, 13 extended upwardly therefrom and disposed and arranged or located between the two compartments 11 of the receptacle 10, and/or disposed and arranged or located between the two groups of the weights 20, 21, and the partitions 12, 13 are disengaged or separated from each other, best shown in FIG. 1. The partitions 12, 13 each include a cavity or notch 14 formed therein, such as formed in the middle or intermediate portion thereof.

As also best shown in FIG. 1, the weights 20, 21 each include a projection or anchoring element or dovetail 23 formed or provided on the inner side portion thereof, i.e. faced or directed toward the partitions 12, 13, and an anchoring member 24, such as dovetail slot 24 formed therein, such as formed in the outer side portion thereof, i.e. faced or directed away from each other and away from the partitions 12, 13, for receiving or engaging with the anchoring element or dovetail 23 of the other weights 20, 21 and for anchoring or retaining or positioning the weights 20, 21 together, and arranged for allowing the weights 20, 21 to be moved up and down relative to each other, but arranged for preventing the weights 20, 21 from being moved sidewise relative to each other and for preventing the weights 20, 21 from being disengaged or separated from each other. One or the first group of the weights 20 each include an orifice 25 formed therein and aligned with each other, and the other or the second group of the weights 21 each include an aperture 26 formed therein and aligned with each other, The adjustable exercise device further comprises a handle mechanism 3 to be disposed and engaged between the two groups of the weights 20, 21, the handle mechanism 3 includes a central handle bar 30 having one or more (such as two) end portions 31, and having one or more (such as two) housings 32, 33 disposed or extended radially and outwardly from the end portions 31 thereof respectively. The housings 32, 33 each include an anchoring member 34, such as a dovetail slot 34 formed therein, such as formed in the outer side portion thereof, i.e. faced or directed toward the weights 20, 21 for receiving or engaging with the dovetail 23 of the weights 20, 21 and for anchoring or retaining or positioning the weights 20, 21 to the housings 32, 33, and arranged for allowing the weights 20, 21 to be detachably or changeably or removably and/or adjustably attached or mounted or secured to the housings 32, 33 and/or the end portions 31 of the handle bar 30 of the handle mechanism 3.

Figure 3:
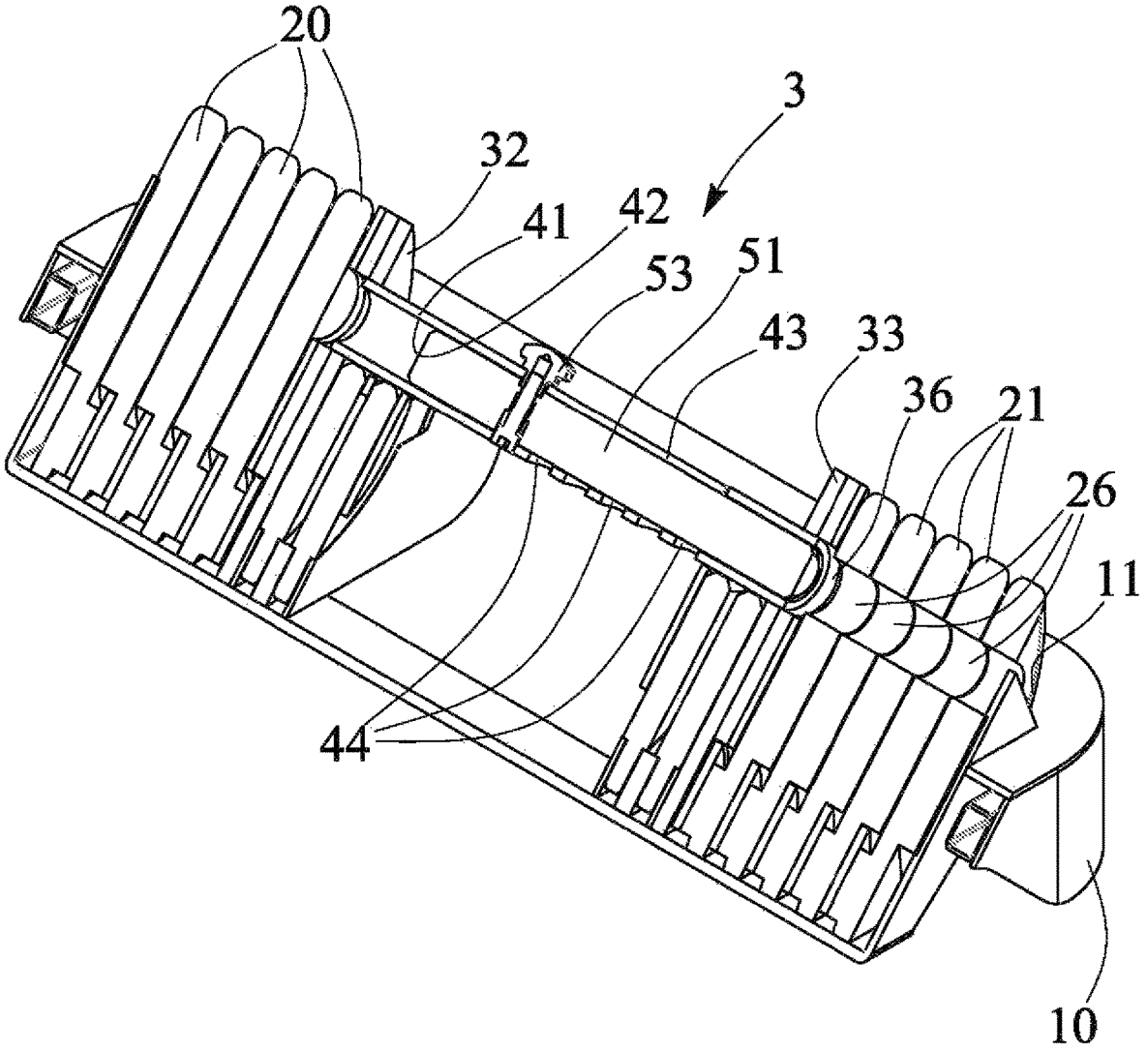
FIG. 3 is a cross sectional view of the adjustable dumbbell, taken along lines 3-3 of FIG. 2.
Figure 4:
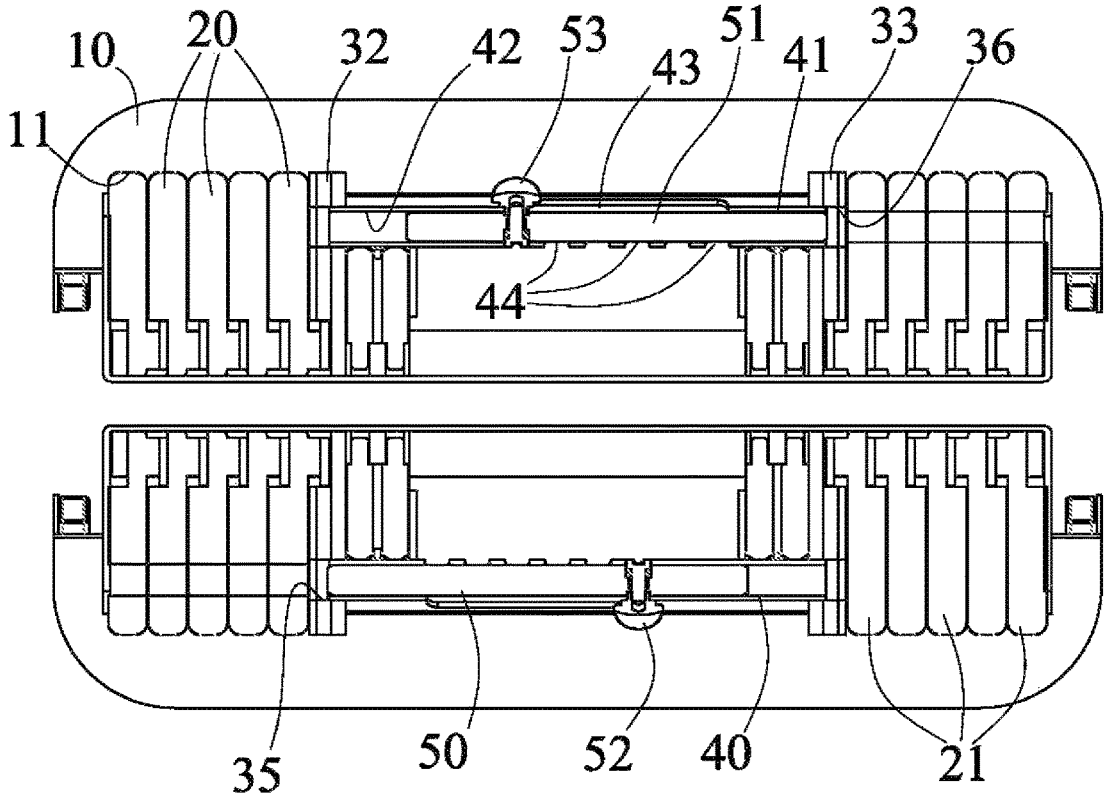
FIG. 4 is another cross sectional view of the adjustable dumbbell, taken along lines 4-4 of FIG. 2.
Figure 5:
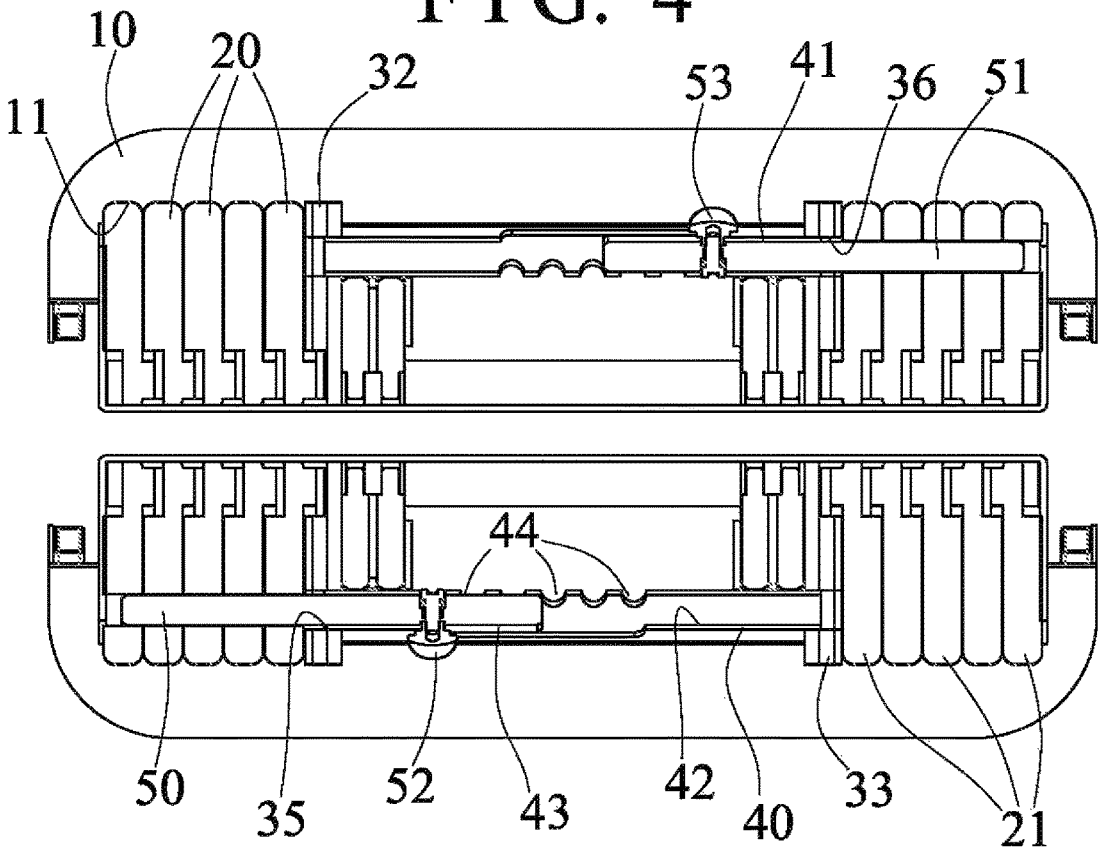
FIG. 5 is a further cross sectional view similar to FIG. 4, illustrating the operation of the adjustable dumbbell assembly.

The handle mechanism 3 further includes one or more (such as two) barrels or tubular members 40, 41 disposed and engaged between the housings 32, 33 and offset or spaced or separated from each other, or the tubular members 40, 41 are arranged or disposed opposite to each other. The tubular members 40, 41 each include a chamber or bore 42 formed therein (FIGS. 3-5). One or the first housing 32 includes an opening 35 formed therein (FIGS. 4-5) and aligned with the bore 42 of the first tubular member 40, and the other or the second housing 33 includes a cavity or hole 36 formed therein and aligned with the bore 42 of the second tubular member 41, and two sliding members or latches 50, 51, such as the first latch 50 and the second latch 51 are slidably received or engaged in the bores 42 of the tubular members 40, 41 respectively, and extendible out of the opening 35 and the hole 36 of the housings 32, 33 respectively for selectively engaging with or into the orifices 25 of the first group of the weights 20 and the apertures 26 of the second group of the weights 21 respectively.

For example, as shown in FIGS. 4-5, the first latch 50 is extendible out of the opening 35 of the first housing 32 and engageable with the orifices 25 of the first group of the weights 20 for selectively and detachably or changeably anchoring or retaining or positioning or coupling a required or predetermined number of the weights 20 to the first housing 32 and the handle bar 30 of the handle mechanism 3. Similarly, the second latch 51 is extendible out of the hole 36 of the second housing 33 and engageable with the apertures 26 of the second group of the weights 21 for selectively and detachably or changeably anchoring or retaining or positioning or coupling a required or predetermined number of the weights 21 to the second housing 33 and the handle bar 30 of the handle mechanism 3. A first and a second spring biased buttons or knobs 52, 53 are attached or mounted to the latches 50, 51 respectively for actuating or moving the latches 50, 51 to engage with the weights 20, 21 selectively and respectively.

For example, the tubular members 40, 41 each include a slot or groove 43 formed therein and communicating with the bore 42 of the tubular members 40, 41 respectively for slidably receiving or engaging with the spring biased knob 52, 53 and for guiding and limiting the spring biased knob 52, 53 and the latches 50, 51 to slide and to move relative to the tubular members 40, 41 and the weights 20, 21 respectively. The tubular members 40, 41 each further include one or more cavities 44 formed therein and communicating with the bore 42 of the tubular members 40, 41 respectively for receiving or engaging with the spring biased knob 52, 53 and for anchoring or retaining or positioning the spring biased knob 52, 53 to the tubular members 40, 41 and thus for anchoring or retaining or positioning the required or predetermined number of the weights 20, 21 to the housings 32, 33 and the handle bar 30 of the handle mechanism 3.

In operation, as shown in FIGS. 3-5, the latches 50, 51 may be actuated to move relative to the tubular members 40, 41 with the spring biased knob 52, 53, to engage with the required or predetermined number of the weights 20, 21, and to anchor or retain or position the required or predetermined number of the weights 20, 21 to the housings 32, 33 and the handle bar 30 of the handle mechanism 3. It is to be noted that the housings 32, 33 may be solidly and stably engaged and coupled together with the handle bar 30 and the tubular members 40, 41, and the weights 20, 21 may be solidly and stably engaged and coupled to the housings 32, 33 with the latches 50, 51 such that the weight or the size or the standard of the weights 20, 21 may be suitably increased, or the weight or the size or the standard of the adjustable exercise device or the adjustable dumbbell may be suitably increased. The handle bar 30 may be solidly and stably received or engaged or rested in the notches 14 of the partitions 12, 13.

Accordingly, the adjustable dumbbell in accordance with the present invention includes a solid and stable structure or configuration for solidly and stably coupling the weight members of the dumbbell together and for preventing the weight members of the adjustable dumbbell from being disengaged or separated from each other, and arranged for allowing the weight or the size or the standard of the weight members or of the adjustable exercise device or the adjustable dumbbell to be suitably increased.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell comprising:

a receptacle, a first weight and a second weight engageable to said receptacle, said first weight including an orifice formed in said first weight, and said second weight including an aperture formed in said second weight, and a handle mechanism including:

a handle bar having two end portions, a first and a second housings disposed on said end portions of said handle bar respectively, a first and a second tubular members engaged between said first and said second housings and separated from each other, a bore formed in each of said first and said second tubular members respectively, said first housing including an opening formed in said first housing and aligned with said bore of said first tubular member, and said second housing including a hole formed in said second housing and aligned with said bore of said second tubular member, a first latch slidably received and engaged in said bore of said first tubular member and extendible out of said opening of said first housing for engaging with said orifice of said first weight and for retaining said first weight to said first housing, and a second latch slidably received and engaged in said bore of said second tubular member and extendible out of said aperture of said second housing for engaging with said hole of said second weight and for retaining said second weight to said second housing.

2. The adjustable dumbbell as claimed in claim 1, wherein said handle mechanism includes a first and a second spring biased knobs attached to said first and said second latches respectively for actuating said latches to engage with said first and said second weights respectively.

3. The adjustable dumbbell as claimed in claim 2, wherein said first and said second tubular members each include a groove communicating with said bore of said tubular member for slidably receiving and engaging with said spring biased knob.

4. The adjustable dumbbell as claimed in claim 2, wherein said first and said second tubular members each include a plurality of cavities communicating with said bore of said tubular member for receiving and engaging with said spring biased knob.

5. The adjustable dumbbell as claimed in claim 1, wherein said first and said second housings each include an anchoring member formed in an outer side portion, and said first and said second weights each include an anchoring element formed on an inner side portion for engaging with said anchoring member and for anchoring and retaining said first and said second weights to said first and said second housings respectively.

6. The adjustable dumbbell as claimed in claim 5, wherein said anchoring members of said first and said second housings are selected from a dovetail slot, and said anchoring elements of said first and said second weights are selected from a dovetail.

7. The adjustable dumbbell as claimed in claim 1, wherein said first and said second weights each include an anchoring member formed in an outer side portion.

8. The adjustable dumbbell as claimed in claim 7 further comprising a third weight including an anchoring element formed on an inner side portion for engaging with said anchoring member of said first weight and for anchoring and retaining said first and said third weights together, said third weight including an orifice formed in said third weight and aligned with said orifice of said first weight for receiving and engaging with said first latch, a fourth weight including an anchoring element formed on an inner side portion for engaging with said anchoring member of said second weight and for anchoring and retaining said second and said fourth weights together, and said fourth weight including an aperture formed in said fourth weight and aligned with said aperture of said second weight for receiving and engaging with said second latch.

9. The adjustable dumbbell as claimed in claim 1, wherein said receptacle includes at least one partition extended from receptacle and disposed between said first and said second weights.

10. The adjustable dumbbell as claimed in claim 9, wherein said at least one partition includes a notch formed in said at least one partition for receiving and engaging with said handle bar.

* * * * *